US006158600A

United States Patent [19]

Ferrucci et al.

[11] Patent Number: 6,158,600

[45] **Date of Patent: *Dec. 12, 2000**

[54] SHELVING SYSTEM HAVING A TILTABLE SHELF WITH AN ADJUSTABLE SIDE

[75] Inventors: Robert D. Ferrucci, Nanticoke; Robert K. Swartz, Dallas, both of Pa.

[73] Assignee: Metro Industries, Inc., Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 09/156,492

[22] Filed: Sep. 18, 1998

[51] Int. Cl.[7] ..... A47B 57/04; A47F 5/00

[52] U.S. Cl. ..... 211/90.02; 211/90.03; 211/187; 211/150; 108/6; 108/147.11

[58] Field of Search ..... 211/187, 59.2, 211/90.02, 90.03, 150, 181.1; 108/182, 193, 147.13, 147.14, 147.15, 147.11, 106, 6, 147.2, 147.22; 403/157

[56] References Cited

U.S. PATENT DOCUMENTS

| | | | |
|---|---|---|---|
| 2,672,385 | 3/1954 | Segal | 108/136 |
| 2,792,944 | 5/1957 | Drommer | 108/106 |
| 3,232,442 | 2/1966 | Wilson | 211/133.2 |
| 3,661,100 | 5/1972 | Tennant | 108/132 |
| 3,680,712 | 8/1972 | Jurasek | 211/59.2 |
| 3,915,097 | 10/1975 | Young | 108/6 |
| 4,025,208 | 5/1977 | Donahue | 403/157 |
| 4,088,202 | 5/1978 | Costello | 182/13 |
| 4,105,347 | 8/1978 | Gossage | 403/157 |
| 4,244,300 | 1/1981 | Leach | 108/116 |
| 4,331,243 | 5/1982 | Doll | 211/59.2 |
| 4,662,523 | 5/1987 | Stein et al. | 211/59.2 |
| 4,858,773 | 8/1989 | Zimmerman | 211/149 |
| 5,048,699 | 9/1991 | Trevaskis | 211/59.2 |
| 5,240,124 | 8/1993 | Buday | 211/59.2 |
| 5,338,137 | 8/1994 | Jensen | 410/146 |
| 5,450,971 | 9/1995 | Boron et al. | 211/134 |
| 5,645,182 | 7/1997 | Miller et al. | 211/134 |
| 5,718,441 | 2/1998 | Kern et al. | 208/79.3 |
| 5,743,412 | 4/1998 | Noble | 211/59.2 |
| 5,762,213 | 6/1998 | Heneveld | 211/187 |
| 5,785,189 | 7/1998 | Gollob et al. | 211/187 |
| 5,884,567 | 3/1999 | Bartz | 108/106 |
| 5,899,346 | 5/1999 | Newkirk | 211/149 |

*Primary Examiner*—Daniel P. Stodola
*Assistant Examiner*—Gregory J. Strimbu
*Attorney, Agent, or Firm*—Fitzpatrick, Cella, Harper & Scinto

[57] ABSTRACT

An adjustable shelf includes a pair of lateral support assemblies, each having a pair of terminal ends. The lateral support assemblies each include a plurality of members movable relative to each other so that a distance between the terminal ends of each lateral support assembly is variable. The adjustable shelf also includes a pair of mounting bars disposed substantially transverse to the lateral support assemblies. A plurality of pivoting mechanisms are also provided, each including a frame secured to one of the mounting bars and a securing member for pivotally securing a respective terminal end of one of the lateral support assemblies to the frame.

22 Claims, 6 Drawing Sheets

SHELVING SYSTEM HAVING A TILTABLE SHELF WITH AN ADJUSTABLE SIDE

BACKGROUND OF THE INVENTION

1. Field of the Invention

The present invention relates generally to an adjustable supporting structure, such as a shelf, and more particularly to a shelf that can be supported in a horizontal position and also adjusted to a number of tilted positions.

The supporting structure of the present invention can be ideally incorporated into a knock-down shelving system having a plurality of supporting posts for supporting one or more shelves at corner assemblies thereof. The shelving system may include, for example, four corner assemblies that may be adjusted to locate a rectangularly-shaped shelf at predetermined heights along the supporting posts. Further, the position of two corner assemblies corresponding to one side of the shelf may be adjusted, i.e., moved vertically on their respective supporting posts, while the other two corner assemblies remain stationary, thereby tilting the shelf to a number of desired angles. Further, a dimension of the shelf may be changed so that the corner assemblies may be secured to supporting posts located at a number of different positions.

2. Description of the Prior Art

Knock-down shelving systems having one or more shelves are known, and each has utility in many applications. For example, such shelving systems may be used in food service, industrial, and hospital settings for storage of any desired items.

Conventional knock-down shelving systems typically include a plurality of supporting posts, at fixed positions, for supporting one or more shelves at each corner. However, while each shelf may be adjusted in the vertical direction, i.e., raised or lowered, the shelf remains in a horizontal orientation between the fixed supporting posts.

Despite the utility and commercial success of such prior art shelving systems, a need exists for an improved shelving system in which the orientation and dimensions of a shelf can be varied to better accommodate a user's needs.

SUMMARY OF THE INVENTION

It is a principal object of the present invention to provide a shelf that can be supported in a plurality of orientations.

It is another object of the present invention to provide an adjustable shelf that may be easily adjusted to tilt at desired angles.

It is a further object of the present invention to provide an adjustable shelf that may adjust at least one dimension of the shelf as the shelf is tilted.

It is a further object of the present invention to provide an adjustable shelf that may adjust at least one dimension of the shelf as the shelf is held in a horizontal position.

It is yet another object of the present invention to provide an adjustable shelf that maintains contact with fixed supporting posts when the shelf is tilted at a desired angle.

In accordance with one aspect of the present invention, an adjustable shelf includes a pair of first lateral sides, each having a first terminal end and a second terminal end and at least one movable member for adjusting a longitudinal dimension between the terminal ends. A pair of second lateral sides is provided, and a plurality of pivoting members pivotally secure the first lateral sides to the second lateral sides.

In accordance with another aspect of the present invention, a shelving system includes a plurality of supporting posts and a tiltable shelf. The shelf includes a pair of first lateral sides, each having a first terminal end and a second terminal end, and at least one movable member for adjusting a longitudinal dimension between the terminal ends. A pair of second lateral sides is also provided and a plurality of pivoting members pivotally secure the first lateral sides to the second lateral sides. A plurality of corner assemblies secure the shelf to corresponding supporting posts.

In yet another aspect of the present invention, a tiltable shelf includes a shelf having variable length first and second lateral sides, and first and second mounting bars. Pivoting means pivotally secure the first and second lateral sides to the first and second mounting bars, and a plurality of corner assemblies secured to the first and second mounting bars secure the shelf to a plurality of supporting posts.

In a further aspect of the present invention, an adjustable shelf includes a pair of first lateral sides fixed at their opposite ends to a pair of second lateral sides. Each of the first lateral sides has a first terminal end and a second terminal end and at least one movable member for adjusting a longitudinal dimension between the terminal ends.

In yet another aspect of the present invention, a tiltable shelf assembly includes a shelf having variable-length first and second lateral sides, and a plurality of corner assemblies securing the shelf to a corresponding plurality of support posts. Tilting means permits the shelf to tilt when a first pair of the corner assemblies are positioned at a different height than a second pair of the corner assemblies. The length of the first and second lateral sides varies as the shelf tilts.

These and other objects, aspects, features and advantages of the present invention will become apparent from the following detailed description of the preferred embodiments taken in conjunction with the accompanying drawings.

DESCRIPTION OF THE PREFERRED EMBODIMENTS

For purposes of explanation only, and to illustrate in part how the present invention may be adapted easily to conventional shelving technology, the adjustable shelf of the present invention is described in use with a knock-down shelving system having a plurality of supporting posts, e.g. four, arranged to support one or more shelves at corner assemblies thereof. One example of such a shelving system can be found in U.S. application Ser. No. 08/893,979, which is incorporated herein by reference. Of course, the adjustable shelf of the present invention may be used in various types of support systems, e.g., cabinets, closets, etc., with the shelving system discussed below being only one example thereof. Moreover, the adjustable shelf of the present invention may be used in conjunction with many other shelving systems and/or corner assemblies and is not limited to use with the particular supporting posts and corner assemblies discussed herein.

Figure 1:
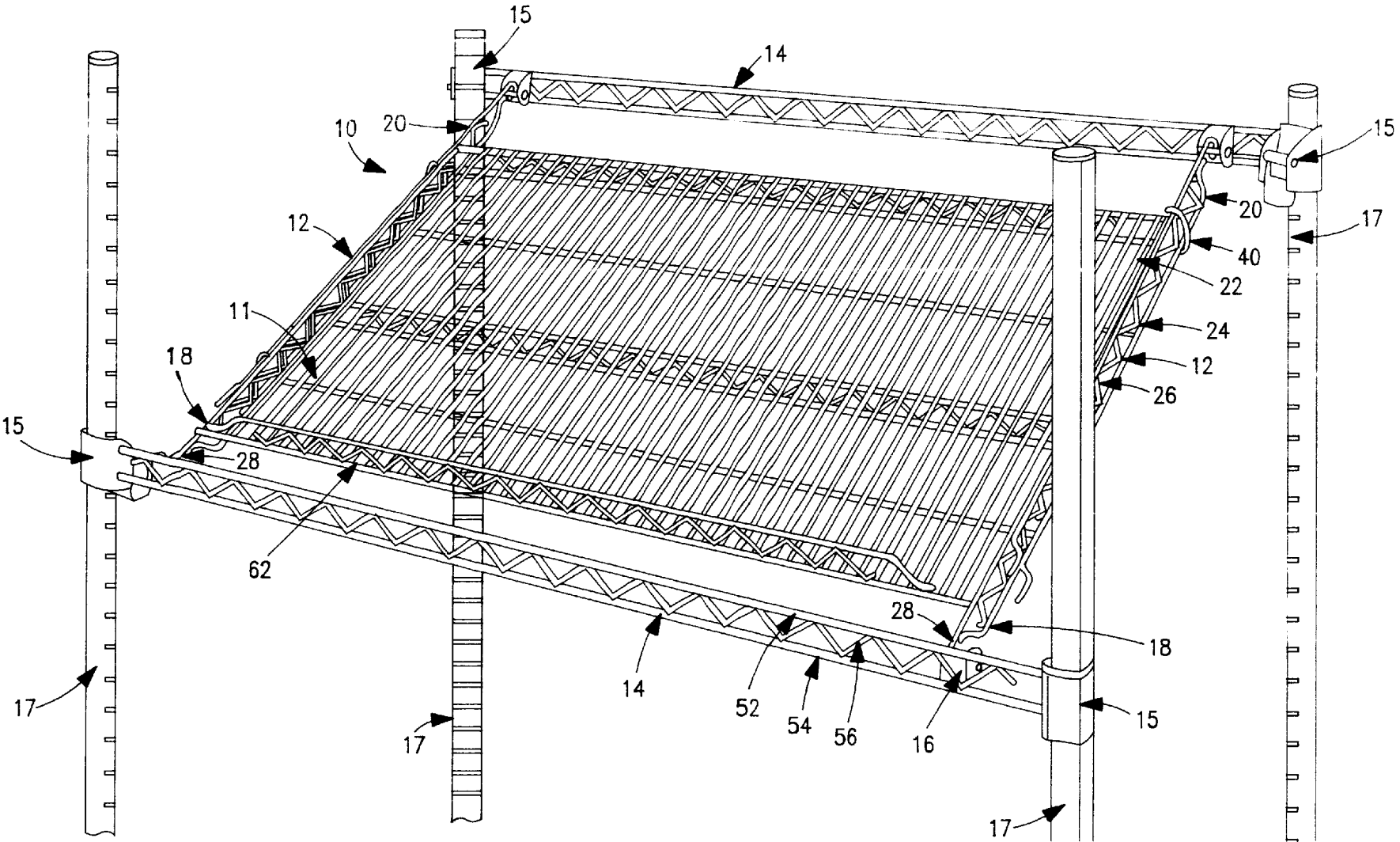
FIG. 1 is a perspective view of an adjustable shelf in accordance with a first preferred embodiment of the present invention.
Figure 2:
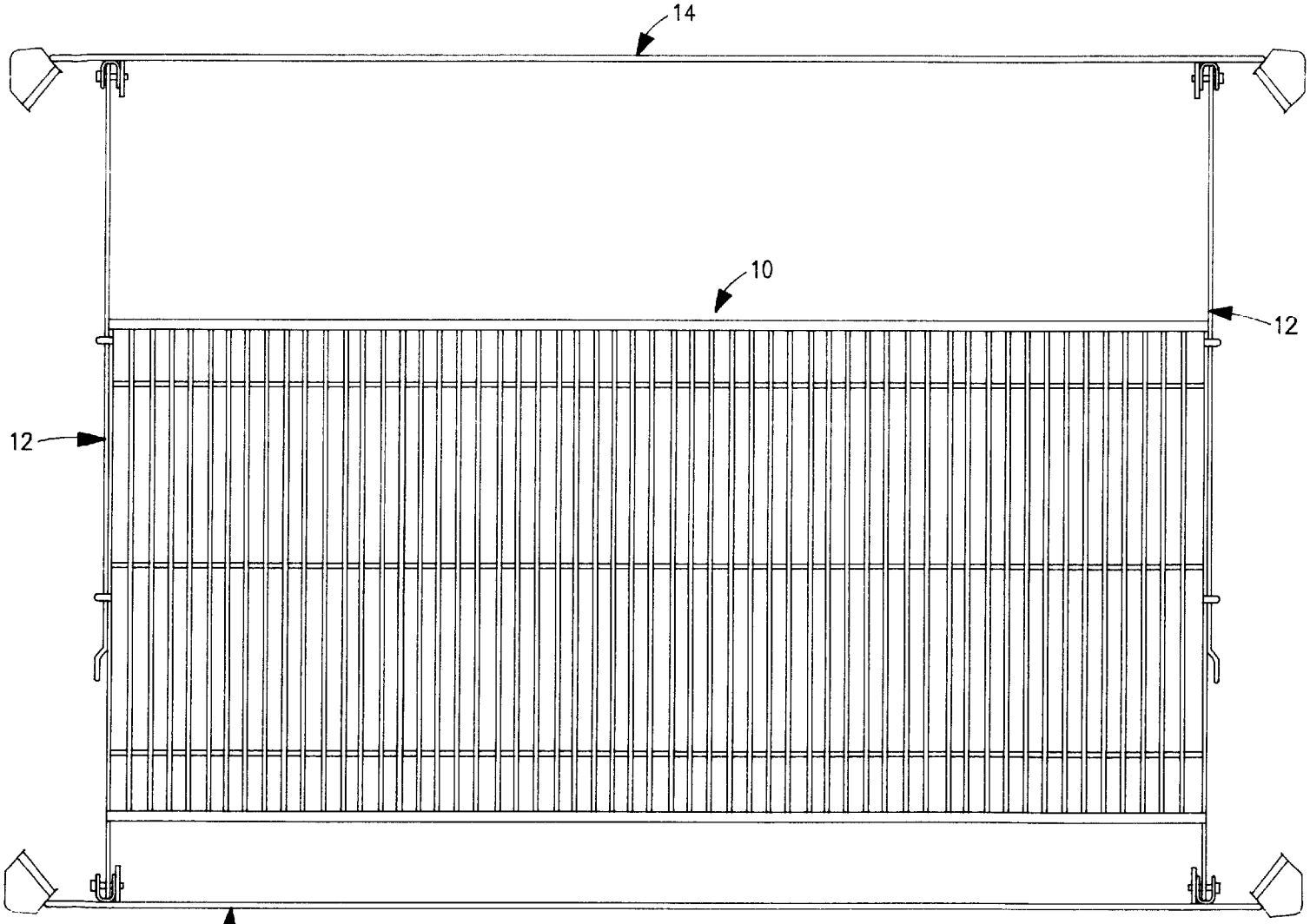
FIG. 2 is a top plan view of the adjustable shelf in accordance with the first preferred embodiment of the present invention.

FIGS. 1 and 2 illustrate an adjustable shelf assembly 10 in accordance with the present invention. The shelf assembly 10 includes two adjustable-length lateral support assemblies 12, or sides, between which is supported, in this non-limiting example, a wire shelf 11. Opposite ends of the lateral support assemblies 12 are pivotally connected to mounting bars 14 by a pivoting mechanism 16. Each end of the mounting bars 14 is secured to a corner assembly 15 and is supported on a corresponding supporting post 17.

Figure 3:
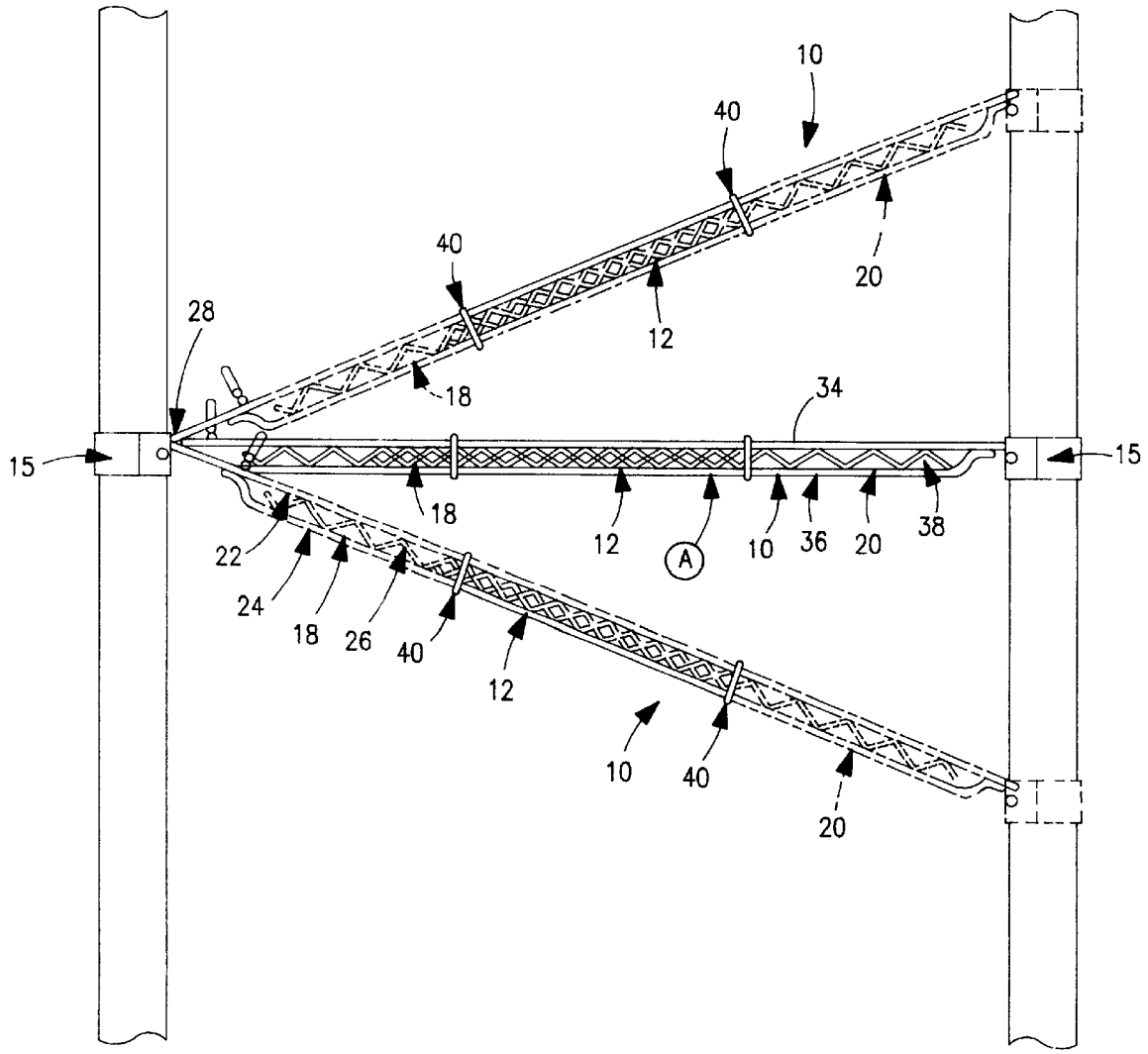
FIG. 3 is a side elevational view of the adjustable shelf in accordance with the first preferred embodiment of the present invention, and illustrating the adjustable tilting shelf tilted at three different positions.

As best seen in FIG. 3, the shelf assembly 10 can be positioned horizontally (position A) by positioning the corner assemblies 15 at the same vertical height on the supporting posts 17. To raise or lower the shelf assembly 10, the corner assemblies 15 of one of the mounting bars 14 are readjusted on the support posts, as the lateral support assemblies 12 increase in length. With this arrangement, the shelf assembly 10 can be supported at various heights and positioned by adjusting the corner assemblies 12. These and other features of the adjustable shelf are explained below in further detail.

The adjustable-length lateral support assemblies 12 are shown in FIGS. 1 through 3. Each lateral support assembly 12 includes an end bar 18 and an adjustable lateral side bar 20 extending along, and parallel to, the end bar 18. The end bar 18 is constructed of, for example, a length of wire bar bent to form a top wire bar 22 and a bottom wire bar 24, with a snake-like support bar 26 for structural support arranged between the top wire bar 22 and the bottom wire bar 24. The top wire bar 22, bottom wire bar 24 and support bar 26 are secured together, e.g., welded to form a single unit.

As best seen in FIGS. 1 and 2, the end bar 18 can form part of the wire shelf 11 itself and includes a pivoting end 28 that extends beyond the load bearing area of the shelf 11. The pivoting end 28 is mounted to the mounting bar 14 via the pivoting mechanism 16 as described in more detail below. The side bar 20 extends along, and parallel to, the end bar 18 of the shelf assembly 10. As seen in FIG. 3, the side bar 20 is constructed in a manner similar to the end bar 18. For example, the side bar 20 may include a top wire bar 34, a bottom wire bar 36 and a snake-like supporting bar 38 formed into an integral unit.

At least one guide member 40 secures the side bar 20 to the end bar 18. The guide member 40 is configured to hold, or clip, the side bar 20 in a sliding or telescoping relationship with the end bar 18. In this manner, the side bar 20 may slide parallel to the end bar 18. As the side bar 20 slides relative to the end bar 18, the length of the lateral support assembly 12 changes accordingly.

As with the end bar 18, a terminal end of the side bar 20 is mounted to the mounting bar 14 via the pivoting mechanism 16. In this way, the sides of the shelf assembly 10 corresponding to the lateral support assemblies 12 can vary in length.

Figure 4:
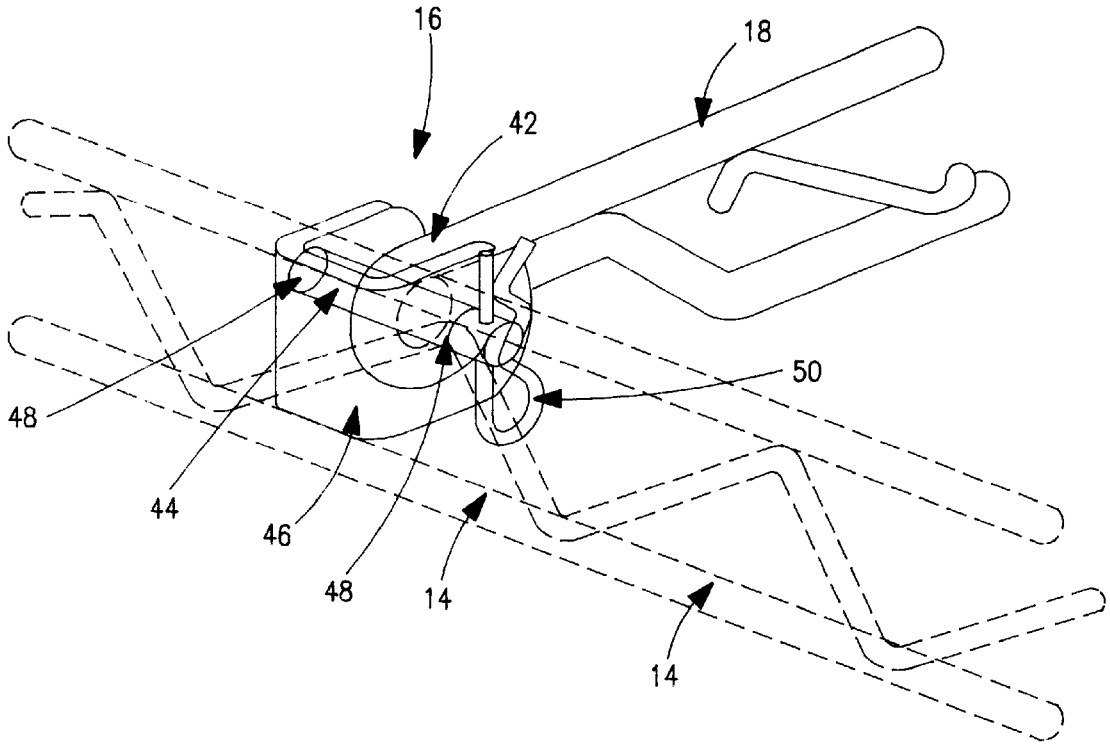
FIG. 4 is a perspective view of a pivoting member of the adjustable shelf in accordance with the first preferred embodiment of the present invention.

As shown in FIG. 4, at the terminal end of both of the side and end bars 20, 18, the top wire bar 34, 22 is formed into a generally oval or circular shaped loop 42. The loop 42 is coupled by a pin 44 to a frame 46, which together form the pivoting mechanism 16. The frame 46 is formed into a generally C-shaped bracket and has two opposing holes 48 for receiving the pin 44. A shaft of pin 44 is inserted into the two opposing holes 48 and is prevented from passing entirely through the holes 48 by unshown stop means, such as an enlarged end or a stop pin. The pin 44 is secured in place by a fastener 50 to prevent the pin 44 from retreating back through the two opposing holes 48. The frame 46 of each pivoting mechanism 16 is secured to the respective mounting bar 14 by, for example, welding a back surface of the frame 46 to the mounting bar 14.

By this arrangement, the terminal ends of the lateral support assembly 12 are each pivotally coupled to a mounting bar 14. It will be appreciated, however, that alternative forms of pivotally coupling the lateral support assemblies 12 and the mounting bars 14 can be provided without departing from the scope of the invention.

Each mounting bar 14 is arranged to be perpendicular in plan view to the lateral support assemblies 12, as shown in FIGS. 1 and 2, and is constructed in a manner substantially similar to the end bars 18 discussed above. Specifically, each mounting bar 14 is formed from a top wire bar 52 and a bottom wire bar 54, with a snake-like support bar 56 arranged therebetween. Further, each end of the mounting bar 14 terminates in a corner assembly 15 for adjusting the position of the mounting bar 14 along a supporting post 17.

A user may tilt the shelf assembly 10 to any number of angles by adjusting the position of the mounting bars 14 along the supporting posts 17. For example, when the shelf assembly 10 is originally set at a horizontal position as illustrated in FIG. 3 (position A), one of the mounting bars 14 may be moved up or down along a first pair of supporting posts 17, while the other mounting bar 14 remains fixed to a second pair of supporting posts 17. As the mounting bar 14 is moved relative to the first pair of supporting posts 17, the lateral support assemblies 12, and thus the shelf assembly 10 itself, rotate around respective pins 44 of the pivoting mechanisms 16. The shelf assembly 10 is thereby adjusted to a desired angle.

Additionally, as the mounting bar 14 is moved along the supporting posts 17 away from a horizontal position, the distance between the mounting bar 14 that is moving along the supporting posts 17 and the stationary mounting bar 14 increases. As this distance increases, the side bars 20 of the shelf assembly 10 slide relative to the end bars 18, thereby increasing the length of opposing lateral sides of the shelf assembly 10. Conversely, as the mounting bar 14 is moved along the supporting posts 17 toward a horizontal position, the distance between the mounting bar 14 that is moving along the supporting posts 17 and the stationary mounting bar 14 decreases. As this distance decreases, the side bars 20 of the shelf assembly 10 slide or telescope relative to the end bars 18, thereby decreasing the length of the opposing lateral sides of the shelf assembly 10. By this arrangement, the mounting bar 14 that is moved along the supporting posts 17 maintains contact with the supporting posts 17, and the shelf assembly 10 is securely supported when tilted to a desired angle.

The wire shelf assembly 10 shown in FIG. 1 may include an end component, or lip, 62 mounted along its lower edge of the shelf assembly 10 to prevent items from falling off of the shelf assembly 10. As an alternative to the wire shelf, the shelf assembly 10 may use, for example, a plastic shelf mat assembly or a solid piece of sheet metal or plastic. The shelf assembly 10 could even be without a shelf surface altogether and may simply form an "open" shelf. Alternatives to the wire-formed bars (end bar 18, side bar 20 and mounting bar 14) are also contemplated and such alternatives would not depart from the scope of the invention.

Figure 5:
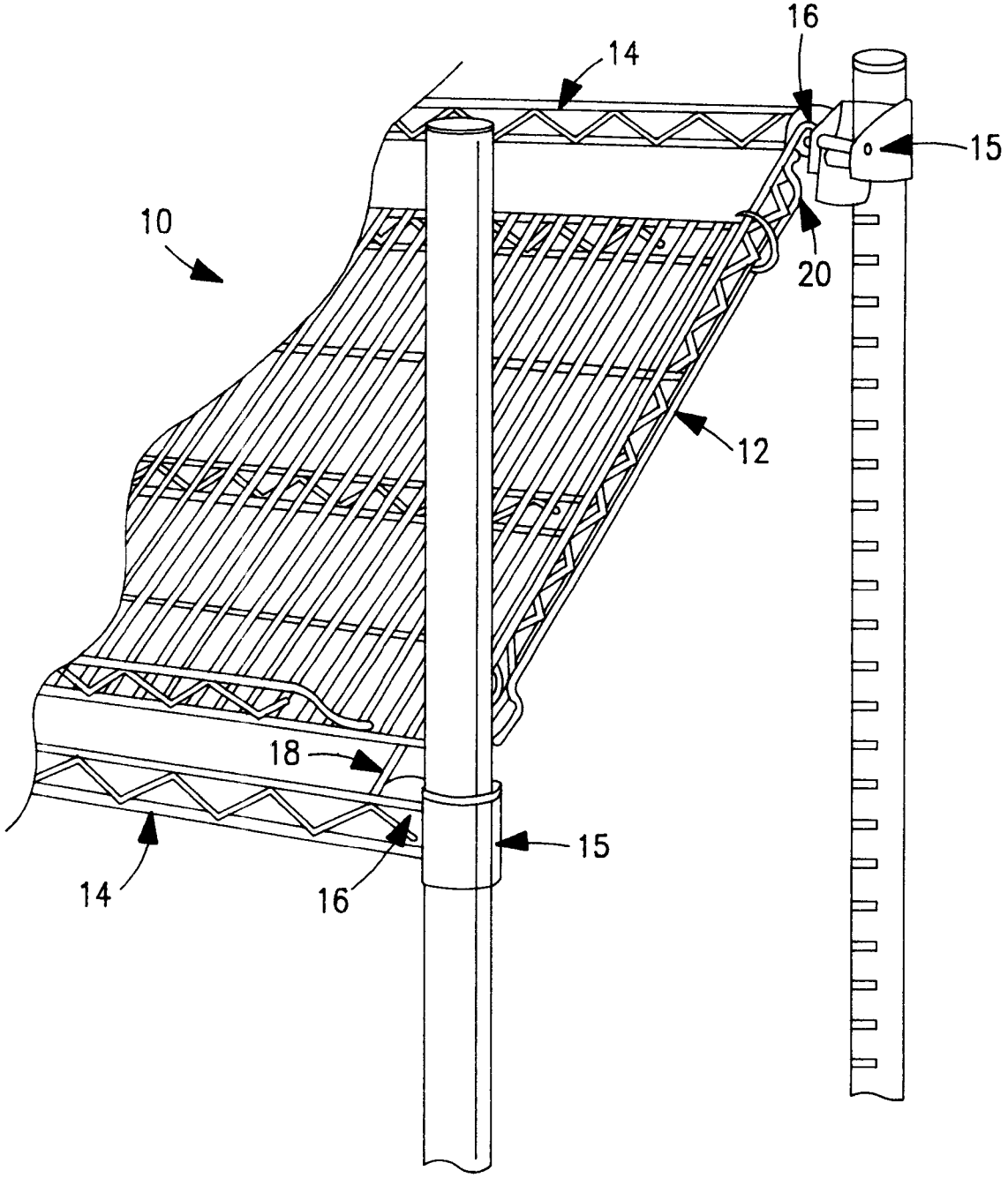
FIG. 5 is a partial perspective view of an adjustable shelf in accordance with a second preferred embodiment of the present invention.

A In a second embodiment of the invention, the pivoting mechanisms are secured to the corner assemblies instead of to the mounting bars. With reference to FIG. 5, which is a partial view for illustrating the differences in this embodiment, the pivoting mechanisms 16 are shown secured to the corner assemblies 15. As with the first preferred embodiment, the side bars 20 may slide or telescope relative to the end bars 18, thereby adjusting the length of opposing lateral sides of the shelf assembly 10 as the shelf assembly 10 is tilted to a desired angle.

As will be appreciated, the adjustable shelf of both the first and second embodiments allows for tilting of the shelf by providing 1) a pivoting feature and 2) an extendible side feature. Alternatives or modifications of these embodiments that accomplish these two features are within the scope of this invention. For example, instead of the adjustable-length lateral support assemblies 12 pivoting, the mounting bars 14 could pivot, either relative to the lateral support assemblies 12 or the corner assemblies 15. In addition, various types of pivoting mechanisms could be used for pivotally connecting the lateral support assemblies 12, the mounting bars 14 and the corner assemblies 15. The disclosed C-shaped bracket 46 and pin 44 is just one non-limiting example of such a pivoting mechanism.

Figure 6:
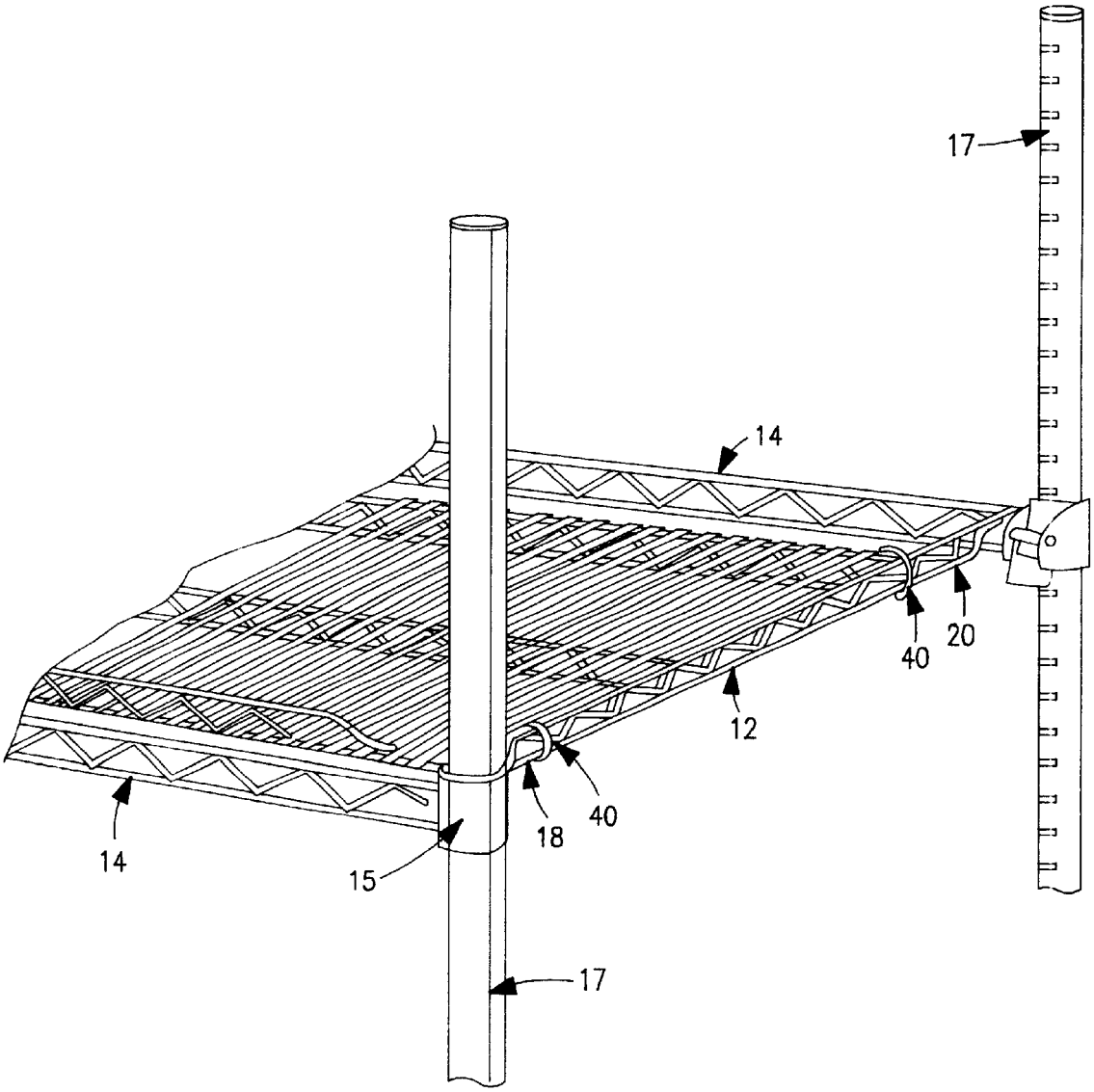
FIG. 6 is a partial perspective view of an adjustable shelf in accordance with a third preferred embodiment of the present invention.

In a third embodiment of the present invention, the end bars 18 and the side bars 20 may be rigidly secured to the mounting bars 14, and the mounting bars 14 may be rigidly secured to the corner assemblies 15, as shown in FIG. 6. The shelf assembly 10 may thereby be securely maintained in a horizontal position, or at any other predetermined orientation, while a width of the shelf assembly 10 can be adjusted.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

What is claimed is:

1. An adjustable shelf comprising:

a plurality of lateral support assemblies, each having a pair of terminal ends, said lateral support assemblies each including a plurality of members movable relative to each other so that a distance between the terminal ends of each lateral support assembly is variable;

a pair of mounting bars disposed substantially transverse to at least two of said plurality of lateral support assemblies, each bar of said pair of mounting bars having a length at least as long as a distance between the at least two of said plurality of lateral support assemblies; and a plurality of pivoting mechanisms, each including a frame secured to a respective one of said mounting bars and securing means for pivotally securing a respective one of the terminal ends of a respective one of said lateral support assemblies to the frame.

2. The adjustable shelf recited in claim 1, wherein each said securing means comprises a pin about which the respective one of the terminal ends may rotate.

3. The adjustable shelf recited in claim 1, wherein said respective one of the terminal ends of said respective one of said lateral support assemblies is secured to a corresponding one of said pivoting mechanisms.

4. The adjustable shelf recited in claim 1, wherein the plurality of members of each of said lateral support assemblies includes a side bar, an end bar, and a guide member slidably securing the side bar adjacent the end bar so that the side bar and the end bar are longitudinally slidable relative to one another such that the distance between the terminal ends of each lateral support assembly is variable.

5. The adjustable shelf recited in claim 1, further comprising a plurality of corner assemblies adapted to secure said mounting bars to a plurality of support posts.

6. The adjustable shelf recited in claim 1, further comprising a supporting surface supported between said at least two of said plurality of lateral support assemblies.

7. The adjustable shelf recited in claim 6, further comprising a lip on one side of said supporting surface.

8. A shelving system, comprising:

a plurality of support posts;

a tiltable shelf, said shelf comprising:

a plurality of lateral support assemblies, each having a pair of terminal ends, said lateral support assemblies each including a plurality of members movable relative to each other so that a distance between the terminal ends of each lateral support assembly is variable;

a pair of mounting bars disposed substantially transverse to at least two of said plurality of lateral support assemblies, each bar of said pair of mounting bars having a length at least as long as a distance between the at least two of said plurality of lateral support assemblies; and a plurality of pivoting mechanisms, each including a frame secured to a respective one of said mounting bars and securing means for pivotally securing a respective one of the terminal ends of a corresponding one of said lateral support assemblies to the frame; and a plurality of corner assemblies securing said mounting bars to said support posts.

9. The shelving system recited in claim 8, wherein each said securing means comprises a pin about which the respective one of the terminal ends may rotate.

10. The shelving system recited in claim 8, wherein said respective one of the terminal ends of said corresponding one of said lateral support assemblies is secured to a corresponding one of said pivoting mechanisms.

11. The shelving system recited in claim 8, wherein the plurality of members of each of said lateral support assemblies includes a side bar, an end bar, and a guide member slidably securing the side bar adjacent the end bar so that the side bar and the end bar are longitudinally slidable relative to one another such that the distance between the terminal ends of each lateral support assembly is variable.

12. The shelving system recited in claim 8, wherein said corner assemblies adjustably secure said mounting bars to said support posts.

13. The shelving system recited in claim 8, further comprising a supporting surface supported between said at least two of said plurality of lateral support assemblies.

14. The shelving system recited in claim 13, further comprising a lip on one side of said supporting surface.

15. A tiltable shelf assembly comprising:

a shelf having a plurality of variable-length lateral support assemblies;

a pair of mounting bars disposed substantially transverse to at least two of said plurality of lateral support assemblies, each bar of said pair of mounting bars having a length at least as long as a distance between the at least two of said plurality of lateral support assemblies;

a plurality of pivoting means for pivotally securing said lateral support assemblies to said mounting bars, each of said pivoting means comprising a frame secured to a respective one of said mounting bars and securing means for pivotally securing a respective end of a corresponding one of said lateral support assemblies to the frame such that the corresponding one of said lateral support assemblies is pivotable relative to said respective one of said mounting bars; and a plurality of corner assemblies secured to said mounting bars, said corner assemblies adapted to secure said shelf to a plurality of support posts.

16. The tiltable shelf assembly recited in claim 15, wherein said lateral support assemblies each include a side bar, an end bar, and a guide member slidably securing the side bar to the end bar.

17. The tiltable shelf assembly recited in claim 16, wherein said respective end of said corresponding one of said lateral support assemblies is secured to a respective one of said pivoting means.

18. An adjustable shelf comprising:

a plurality of lateral support assemblies, each having a pair of terminal ends, said lateral support assemblies each including a side bar, an end bar, and a guide member slidably securing the side bar to the end bar so that the side bar and the end bar are longitudinally slidable relative to one another such that a distance between the terminal ends of each lateral support assembly is variable;

a plurality of mounting bars disposed substantially transverse to at least two of said plurality of lateral support assemblies, each bar of said plurality of mounting bars having a length at least as long as a distance between the at least two of said plurality of lateral support assemblies; and a plurality of pivoting means for pivotally securing said lateral support assemblies to said mounting bars, each of said pivoting means comprising a frame secured to a respective one of said mounting bars and securing means for pivotally securing a respective one of said ends of a corresponding one of said lateral support assemblies to the frame such that the corresponding one of said lateral support assemblies is pivotable relative to said respective one of said mounting bars.

19. The adjustable shelf recited in claim 18, further comprising a supporting surface supported between said at least two of said plurality of lateral support assemblies.

20. The adjustable shelf recited in claim 19, further comprising a lip on one side of said supporting surface.

21. A tiltable shelf assembly, comprising:

a shelf having a plurality of variable-length lateral support assemblies and a plurality of mounting bars disposed substantially transverse to at least two of said plurality of lateral support assemblies;

a plurality of corner assemblies adapted to secure said shelf to a plurality of support posts; and tilting means for tilting said shelf relative to the support posts when a first adjacent pair of said corner assemblies is positioned at a height different than that of a second adjacent pair of said corner assemblies, each of said tilting means comprising a frame secured to a respective one of said mounting bars and said frame being coupled to a respective end of a corresponding one of said lateral support assemblies such that the corresponding one of said lateral support assemblies is pivotable about said frame, wherein a length of each of said lateral support assemblies varies as said shelf tilts relative to the support posts.

22. A shelving system, comprising:

a plurality of support posts;

at least one tiltable shelf, said shelf comprising:

a pair of lateral support assemblies each having a pair of terminal ends, said lateral support assemblies each including a plurality of members movable relative to each other so that a distance between the terminal ends of each one of said lateral support assemblies is variable;

a pair of mounting bars disposed substantially transverse to said lateral support assemblies, each bar of said pair of mounting bars having a length at least as long as a distance between the lateral support assemblies; and a plurality of pivoting mechanisms, each including a frame secured to a respective one of said mounting bars and securing means for pivotally securing a respective one of the terminal ends of a respective one of said lateral support assemblies to the frame; and a plurality of corner assemblies securing said mounting bars to said support posts.

* * * * *